US011873691B2

(12) United States Patent
Wood et al.

(10) Patent No.: US 11,873,691 B2
(45) Date of Patent: Jan. 16, 2024

(54) LOAD ANCHOR WITH SEALING

(71) Applicant: Schlumberger Technology Corporation, Sugar Land, TX (US)

(72) Inventors: Peter Wood, Aberdeen (GB); Neil Thomson, Aberdeen (GB); Davidson Harman, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 235 days.

(21) Appl. No.: 17/618,024

(22) PCT Filed: Jun. 9, 2020

(86) PCT No.: PCT/US2020/036803
§ 371 (c)(1),
(2) Date: Dec. 10, 2021

(87) PCT Pub. No.: WO2020/251940
PCT Pub. Date: Dec. 17, 2020

(65) Prior Publication Data

US 2022/0259934 A1 Aug. 18, 2022

Related U.S. Application Data

(60) Provisional application No. 62/861,614, filed on Jun. 14, 2019.

(51) Int. Cl.
*E21B 33/128* (2006.01)
*E21B 23/01* (2006.01)
(Continued)

(52) U.S. Cl.
CPC ..... *E21B 23/01* (2013.01); *E21B 33/128* (2013.01); *E21B 33/1216* (2013.01); *E21B 33/1292* (2013.01)

(58) Field of Classification Search
CPC ..... E21B 33/1216; E21B 33/128; E21B 33/1292; E21B 23/01; E21B 23/04
See application file for complete search history.

(56) References Cited

U.S. PATENT DOCUMENTS 1,547,025 A 7/1925 Harold
3,977,473 A 8/1976 Page, Jr.
(Continued)

FOREIGN PATENT DOCUMENTS

CN 203130031 8/2013
EP 0898048 A2 2/1999
(Continued)

OTHER PUBLICATIONS

First Examination Report received in GCC Patent Application No. 2015/09339 dated Nov. 29, 2017, 4 pages.
(Continued)

*Primary Examiner* — Cathleen R Hutchins
*Assistant Examiner* — Ronald R Runyan
(74) *Attorney, Agent, or Firm* — Jeffrey D. Frantz

(57) ABSTRACT

A technique facilitates anchoring between tubular structures in various well applications. The technique may utilize a load anchor having a radially expandable mandrel with an interior passage. Circumferential biasing members are mounted around the mandrel and each circumferential biasing member has a biasing surface. Additionally, a gripper system is positioned axially between the circumferential biasing members. The gripper system is configured such that engagement with the biasing surface of either circumferential biasing member causes radially outward biasing of the gripper system upon movement of the mandrel in either axial direction. A sealing element also may be disposed about the mandrel. The configuration of the gripper system and the circumferential biasing members protects the sealing
(Continued)

element against undue axial movement once the load anchor is radially expanded into engagement with a surrounding surface.

20 Claims, 4 Drawing Sheets

(51) Int. Cl.
*E21B 33/12* (2006.01)
*E21B 33/129* (2006.01)

(56) References Cited

U.S. PATENT DOCUMENTS

| | | | |
|---|---|---|---|
| 5,220,959 | A | 6/1993 | Vance, Sr. |
| 5,749,585 | A | 5/1998 | Lembcke |
| 6,467,540 | B1 | 10/2002 | Weinig et al. |
| 8,678,083 | B2 | 3/2014 | Xu |
| 8,875,799 | B2 | 11/2014 | Smith et al. |
| 9,518,453 | B2 | 12/2016 | Dilber et al. |
| 9,840,878 | B2 | 12/2017 | Martin et al. |
| 10,400,529 | B2 | 9/2019 | Patton |
| 2003/0205386 | A1 | 11/2003 | Johnston et al. |
| 2004/0182583 | A1 | 9/2004 | Doane et al. |
| 2004/0244994 | A1 | 12/2004 | Jackson et al. |
| 2007/0000664 | A1 | 1/2007 | Ring et al. |
| 2011/0038742 | A1 | 2/2011 | Fleig et al. |
| 2012/0205873 | A1 | 8/2012 | Turley |
| 2012/0273236 | A1 | 11/2012 | Gandikota et al. |
| 2015/0198005 | A1 | 7/2015 | Delzell et al. |
| 2015/0315864 | A1 | 11/2015 | Patton |
| 2015/0345249 | A1 | 12/2015 | Gorrara et al. |
| 2016/0047176 | A1 | 2/2016 | Martin |
| 2016/0076324 | A1 | 3/2016 | Allen et al. |
| 2016/0090801 | A1 | 3/2016 | Hazelip et al. |
| 2017/0356267 | A1 | 12/2017 | Hazel |

FOREIGN PATENT DOCUMENTS

| | | | |
|---|---|---|---|
| GB | 2266908 | A | 11/1993 |
| GB | 2398312 | A | 8/2004 |
| GB | 2501988 | A | 11/2013 |
| GB | 2512506 | A | 10/2014 |
| WO | 2005121498 | A1 | 12/2005 |
| WO | 2007119052 | A1 | 10/2007 |
| WO | 2012127229 | A2 | 9/2012 |
| WO | 2014006373 | A2 | 1/2014 |
| WO | 2020251940 | A1 | 12/2020 |

OTHER PUBLICATIONS

Second Examination Report received in GCC Patent Application No. 2015/09339 dated May 31, 2018, 3 pages.
Combined Search and Examination Report received in GB Patent Application No. GB1407746.5 dated Aug. 22, 2014, 4 pages.
Office Action received in European Patent Application No. 15726243.7 dated Jan. 27, 2020, 6 pages.
International Search Report and Written Opinion of International Patent Application No. PCT/GB2015/051270 dated Oct. 28, 2015, 11 pages.
International Preliminary Report on Patentability of International Patent Application No. PCT/GB2015/051270 dated Nov. 8, 2016, 8 pages.
Office Action received in the BR Application BR112016025643-3, dated Jul. 12, 2020 (8 pages).
International Search Report and Written Opinion of International Patent Application No. PCT/US2020/036803 dated Sep. 21, 2020 (14 pages).

LOAD ANCHOR WITH SEALING

CROSS-REFERENCE TO RELATED APPLICATION

The present document is based on and claims priority to U.S. Provisional Application Ser. No. 62/861,614, filed Jun. 14, 2019, which is incorporated herein by reference in its entirety.

BACKGROUND

In many well applications, casing is deployed downhole into a wellbore and cemented in place within the wellbore. Additionally, various types of tubing or tools may be deployed and anchored within the casing or within other tubular structures. For example, various types of liners may be deployed and anchored within a surrounding tubing. The anchoring may be achieved by using a load anchor on the internal tubular structure. The load anchor is radially expanded into gripping engagement with the surrounding tubular structure, e.g. casing. Sometimes a seal is employed on the load anchor to provide a sealed engagement between the inner and outer tubular structure. However, the seal can be subjected to wear between the tubular structures, e.g. between inner and outer casings.

SUMMARY

In general, a system and methodology are provided for facilitating anchoring between tubular structures in various well applications. The technique may utilize a load anchor having a mandrel with an interior passage. The mandrel is radially expandable upon application of sufficient pressure within the internal passage. Additionally, circumferential biasing members are mounted around the mandrel and each circumferential biasing member has a biasing surface. In some embodiments, each circumferential biasing member may be in the form of a beam spring secured along the exterior of the mandrel by a suitable retention mechanism. Additionally, a gripper system is positioned axially between the circumferential biasing members. The gripper system is configured such that engagement with the biasing surface of either circumferential biasing member causes radially outward movement of the gripper system upon movement of the mandrel in either axial direction. A sealing element also may be disposed about the mandrel. The configuration of the gripper system and the circumferential biasing members protects the sealing element against undue axial movement once the load anchor is radially expanded into engagement with a surrounding surface.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
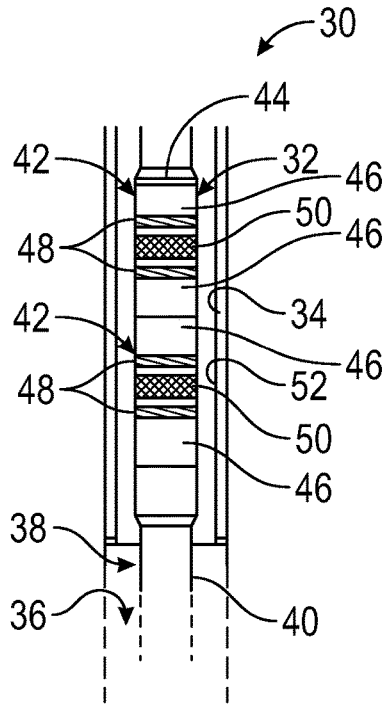
FIG. 1 is a schematic illustration of an example of a load anchor deployed in a tubular, e.g. a casing, disposed in a borehole, according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate anchoring between tubular structures in various well applications. The technique may utilize a load anchor having a mandrel with an interior passage. The mandrel is radially expandable upon application of sufficient pressure within the interior passage. By way of example, a setting tool may be used to seal off the interior passage and to enable application of hydraulic pressure within the interior passage. However, the interior passage may be sealed off via closing a valve or via a ball dropped to block flow along the interior passage. Regardless of the technique used to close off the interior passage within the mandrel, the closure allows pressure to be increased in the interior passage until the mandrel, e.g. a thin-walled metal section of the mandrel, is radially expanded toward a surrounding casing or other wellbore tubular.

Additionally, the load anchor comprises circumferential biasing members mounted around the mandrel. Each circumferential biasing member has a biasing surface which may be a sloped/angled surface or other suitable surface to facilitate anchoring as explained in greater detail below. In some embodiments, each circumferential biasing member may be in the form of a beam spring secured along the exterior of the mandrel by a suitable retention mechanism. The load anchor also includes a gripper system positioned axially between the circumferential biasing members. Upon radial expansion of the mandrel, the gripper system is forced into engagement with the surrounding surface, e.g. the surrounding interior casing surface. A sealing element also is disposed about the mandrel and expands with the mandrel into sealing engagement with the surrounding surface.

The gripper system is configured such that engagement with the biasing surface of either circumferential biasing member causes radially outward biasing of the gripper system upon movement of the mandrel in either axial direction. This radially outward biasing ensures secure engagement of the load anchor with the surrounding surface while limiting axial sliding motion of the sealing element with respect to the surrounding surface. If the circumferential biasing members are in the form of beam springs, the beam springs may be preloaded so that the beam springs are able to expand axially to act against the biasing surface and thus maintain a radially outward biasing of the gripper system. The configuration of the gripper system and the circumferential biasing members effectively protects the sealing element against wear/damage once the load anchor is radially expanded into engagement with the surrounding surface.

Referring generally to FIG. 1, an example of a well system 30 is illustrated. In this embodiment, the well system 30 comprises a load anchor 32 positioned in a surrounding tubular 34, e.g. casing, which is located in a borehole 36. The borehole 36 may be a wellbore used for the production of hydrocarbon fluids such as oil and natural gas. In the example illustrated, the load anchor 32 is connected along an inner tubular 38, e.g. an inner casing string, and may be radially expanded for gripping engagement with the surrounding tubular 34. By way of example, the tubing string 38 may comprise a liner 40 or other type of tubular member.

The load anchor 32 may comprise a single load anchor section 42 or a plurality of load anchor sections 42. According to an embodiment, each load anchor section 42 comprises a mandrel 44. It should be noted mandrel 44 may be a common mandrel passing through a plurality of the load anchor sections 42. In the example illustrated, each load anchor section 42 comprises a plurality of circumferential biasing members 46, e.g. a pair of circumferential biasing members 46, mounted around the mandrel 44. Additionally, a gripper system 48 is positioned around the mandrel 44 and between circumferential biasing members 46. A sealing element 50 also is disposed about the mandrel 44 and oriented for sealing engagement with a surrounding surface 52 of tubular 34.

By way of example, the surrounding surface 52 may be the interior surface of casing/tubular 34. When the mandrel 44 is radially expanded, the gripper system 48 and the sealing element 50 are expanded into engagement with the surrounding surface 52 to provide a secure, sealed anchor connection between outer tubular 34 and inner tubular 38. As explained in greater detail below, the gripper system 48 cooperates with circumferential biasing members 46 to protect the sealing element 50 against axial sliding motion with respect to surrounding surface 52 after the load anchor 32 is radially expanded into engagement with the surrounding surface 52.

Figure 2:
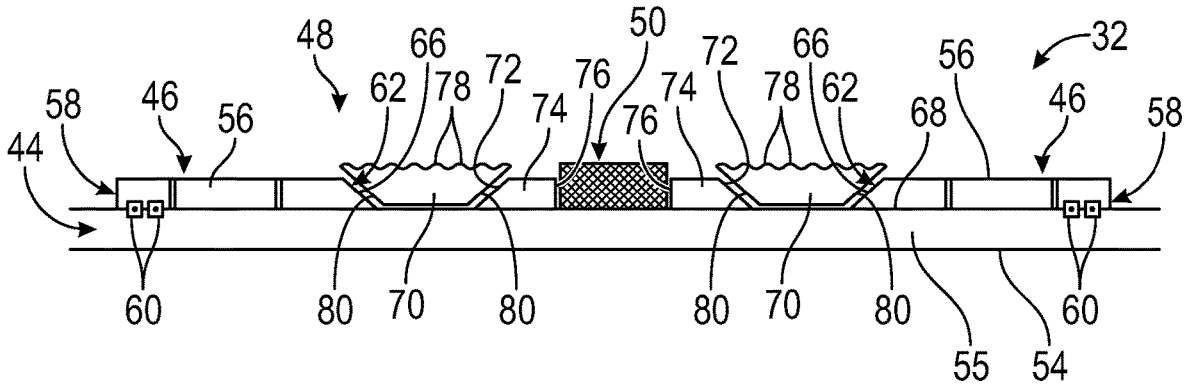
FIG. 2 is a schematic cross-sectional illustration of a portion of one type of load anchor, according to one or more embodiments of the present disclosure.

With additional reference to FIG. 2, an example of load anchor 32 is illustrated. In this embodiment, the load anchor 32 comprises a single load anchor section 42. The load anchor 32 is illustrated partially in cross-section to facilitate explanation of the components and function of the load anchor 32. As illustrated, the mandrel 44 has an interior passage 54 which may be used to accommodate, for example, passage of fluid and/or well tools.

According to an embodiment, the mandrel 44 may be constructed with a thin-walled tube section 55 bounded by thicker walled ends. The thin-walled tube section 55 may be expanded by deploying a setting tool within the mandrel 44. The setting tool comprises packer elements which engage with the inner surface of the mandrel 44 at the thicker walled ends. Hydraulic fluid under pressure is then applied to the setting tool which delivers the hydraulic fluid into the interior passage 54 of mandrel 44. The packer elements contain the hydraulic fluid so that pressure may be increased to a pressure which causes elastic and then plastic deformation of at least the thin-walled tube section 55 of mandrel 44 as the mandrel 44 is radially expanded. The mandrel 44 is radially expanded until the gripper system 48 and sealing element 50 are moved into appropriate contact with surrounding surface 52. The hydraulic pressure is then released and the setting tool is removed.

In the illustrated example, the circumferential biasing members 46 are in the form beam springs 56 which each surround the mandrel 44 and may be secured to the mandrel 44 via a suitable retention mechanism 58. The retention mechanism 58 may be used to secure various types of circumferential biasing members 46 and may comprise various screws, keys, threads, and/or other retention mechanisms. In some embodiments, each retention mechanism 58 comprises single or plural retaining wires 60 which are received in corresponding slots formed in mandrel 44 and in the corresponding circumferential biasing member 46. The retaining wires 60 may be oriented circumferentially at axially outlying ends of the beam springs 56 to prevent axial movement of the axially outlying ends of the beam springs 56 along mandrel 44. In one or more embodiments of the present disclosure, the retaining wires 60 may be circular, rectangular, or any other shape without departing from the scope of the present disclosure.

Each circumferential biasing member 46/beam spring 56 may have a biasing surface 62 oriented to bias gripper system 48 in a radially outward direction when engaged with the gripper system 48 under sufficient axial force. By way of example, each biasing surface 62 may be in the form of an angled section 66 formed at a suitable angle, e.g. 30°-60°, with respect to an outer surface 68 of a cylindrical portion/body of mandrel 44.

According to the embodiment illustrated, the gripper system 48 comprises a plurality of gripper members 70, e.g. a pair of gripper members 70. The gripper members 70 are disposed about the mandrel 44 and each gripper member 70 is axially bounded by the biasing surface 62/angled section 66 on one side and by a fixed angle section 72 on the other side. The fixed angle section 72 may be formed at a suitable angle, e.g. 30°-60°, with respect to the outer surface 68 of mandrel 44. As illustrated, the fixed angle section 72 may be established by a radially extended portion 74 which is a unitary part of mandrel 44 extending radially outward from outer surface 68.

In this example, the sealing element 50 is disposed about the mandrel 44 and trapped in an axial position between abutments 76. According to an embodiment, the sealing element 50 may be disposed between gripper members 70. Abutments 76 may be formed on radially extended portions 74. In some embodiments, however, the sealing element 50 may not be mounted between the gripper members 70 and, instead, may be mounted about the mandrel 44 at a position axially outside of the plurality of gripper members 70.

The sealing element 50 may be formed of an elastomeric material, metal material, or other suitable material able to form the desired seal with surrounding surface 52. Additionally, the sealing element 50 may be formed from a single circumferential element or a plurality of circumferential elements which cooperate to form the desired seal against the surrounding surface 52.

Each gripper member 70 may comprise teeth 78 or other suitable gripping features designed to engage the surrounding surface 52 when the load anchor 32 is radially expanded. Additionally, each gripper member 70 may comprise angled surfaces 80 oriented to engage biasing surface 62/angled section 66 and fixed angle section 72.

To protect the sealing element 50 against axial loading of mandrel 44 in both directions, the biasing surfaces 62 of the respective circumferential biasing members 46 may be oriented toward each other in an axially inward direction as illustrated. Additionally, the fixed angle sections 72 may be oriented in an axially outward direction at a position between the pair of illustrated gripper members 70. Thus, regardless of the direction of loading on mandrel 44, the orientation of the biasing surfaces 62 and fixed angle sections 72 tends to bias the corresponding gripper members 70 in a radially outward direction so as to more firmly engage the surrounding surface 52. The firm engagement of gripper members 70 with surface 52 of the surrounding casing/tubular 34 reduces the potential sliding of sealing element 50 along surface 52. Also, by positioning the fixed angle sections 72 on an axially inward side of gripper members 70 while beam springs 56 are positioned on an axially outward side of gripper members 70, the ability of the sealing element 50 to slide axially is resisted. In other words, once the load anchor 32 is radially expanded, the fixed angled sections 72 block axial shifting of the sealing element 50 regardless of the direction of axial loading on mandrel 44. It should be noted the blocking of axial shifting of sealing element 50 also can be accomplished by placing the beam springs 56 on an axially inward side of gripper members 70 while fixed angle sections 72 are positioned on an axially outward side of gripper members 70.

Upon radial expansion of the mandrel 44, the circumferential biasing members 46, gripper members 70, and sealing element 50 also are radially expanded toward the surrounding surface 52. The radial expansion effectively forces gripper members 70 and sealing element 50 into engagement with the surrounding surface 52. In some applications, the circumferential biasing members 46 and gripper members 70 may be constructed to fracture/break in a controlled manner so as to release hoop stress during transition of the gripper members 70 and sealing element 50 into engagement with the surrounding surface 52. By way of example, the circumferential biasing members 46, gripper members 70, and/or other rings or features of load anchor 32 may be formed with axial slots machined to leave a thin portion of material. When expansion of the mandrel 44 provides sufficient force to break each of these thin portions, the components fracture in a controlled manner. Upon fracture, the components no longer have strength in the hoop direction so the components are free to continue expanding with the mandrel 44.

Once load anchor 32 is expanded, axial loading/shifting of the mandrel 44 causes interaction of gripper element surfaces 80 with corresponding biasing surfaces 62 and fixed angle sections 72. The interaction causes radially outward movement of the gripper system 48 and thus more secure engagement of load anchor 32 with the surrounding surface 52, e.g. with the surrounding casing surface. As a result, the gripper system 48 absorbs axial loading on mandrel 44 and protects the sealing element 50 from detrimental sliding motion with respect to surface 52.

When the circumferential biasing members 46 are in the form of beam springs 56, the beam springs 56 may be axially compressed, installed along the exterior of the mandrel 44, and fixed in place. The beam springs 56 are thus able to provide an axial biasing force against the corresponding gripper members 70. The beam springs 56 continue to provide this axial biasing force during and after radial expansion of mandrel 44. However, once the beam springs 56 and gripper members 70 undergo the controlled fracture to release hoop stress, the spring forces applied by beam springs 56 are able to drive the gripper members 70 in the radially outward direction and into surface 52.

In other words, each beam spring 56 applies a biasing force in an axial direction along the mandrel 44 as each beam spring 56 tries to return to its original length. Because the outlying ends of beam springs 56 are locked in place via retention mechanisms 58, each axially expanding beam spring 56 tends to force the corresponding biasing surface 62 against the angled surface 80 of the adjacent gripper member 70. This interaction between angled surfaces 62, 72 and 80 tends to drive the corresponding gripper members 70 radially outward against the surrounding surface 52, thus helping secure the load anchor 32 with respect to the surrounding tubular 34. The squeezing of the gripper members 70 helps maintain grip against the surrounding tubular 34 when the load anchor 32 has been fully expanded.

Figure 3:
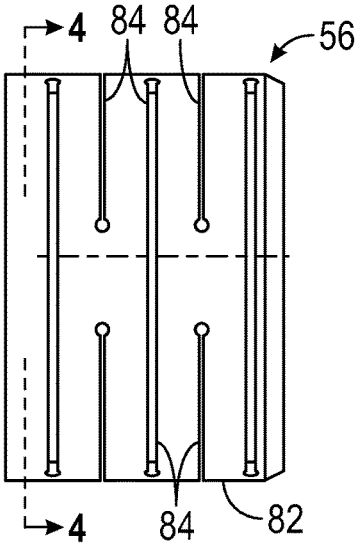
FIG. 3 is a side view of an example of a beam spring which may be used in a load anchor, according to one or more embodiments of the present disclosure.
Figure 4:
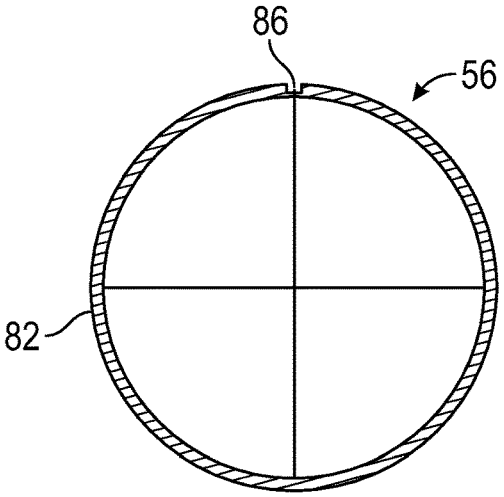
FIG. 4 is a cross-sectional view taken generally along line 4-4 of FIG. 3, according to one or more embodiments of the present disclosure.

Referring generally to FIGS. 3 and 4, an example of one type of beam spring 56 is illustrated. In this example, each beam spring 56 comprises a cylinder 82 sized to fit around mandrel 44. The cylinder 82 may be formed of a suitable metal or other spring material. Circumferential slots 84 are cut through the cylinder 82 in a generally circumferential direction over a portion of the circumference of the cylinder 82. The circumferential slots 84 enable axial compression of the beam spring 56 which, in turn, allows the beam spring 56 to apply an axial spring force.

Additionally, an axial slot 86 (see FIG. 4) may be cut partially into the cylinder 82. During radial expansion of the beam spring 56, the cylinder 82 fractures along the axial slot 86 to remove hoop stress. Similar axial slots 86 may be formed along the gripper members 70 and/or rings or other components mounted about mandrel 44. During radial expansion of the load anchor 32, the controlled fracture of gripper elements 70 facilitates transformation of the beam springs 56 from their axially compressed configuration to an axially extended configuration. In the axially extended configuration, the beam springs 56 act against the corresponding angled surfaces 80 of gripper members 70 to bias the gripper members 70 in a radially outward direction.

Figure 5:
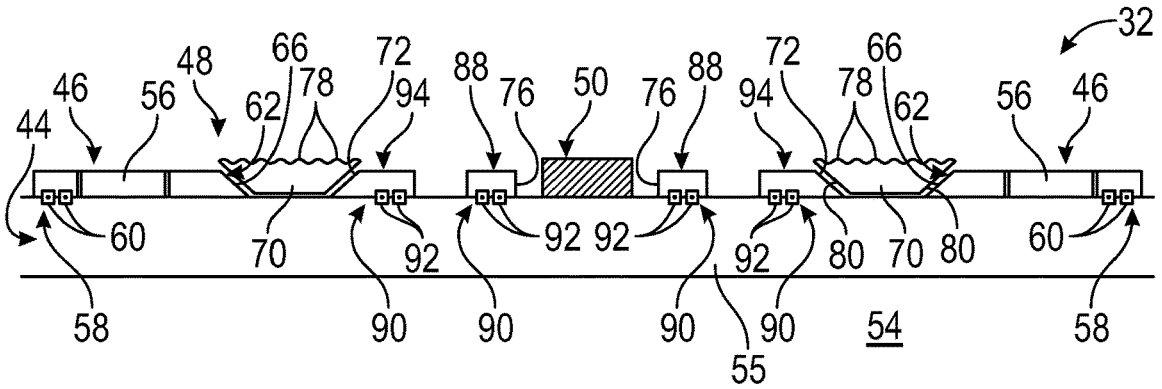
FIG. 5 is a schematic cross-sectional illustration of a portion of another type of load anchor, according to one or more embodiments of the present disclosure.

Referring generally to FIG. 5, another embodiment of load anchor 32 is illustrated. In this example, the load anchor 32 is similar to that described with reference to FIG. 2. However, the abutments 76 are formed on rings 88 which may be mounted about mandrel 44 on both sides of sealing element 50 and axially secured to mandrel 44 via ring retention mechanisms 90. By way of example, the ring retention mechanisms 90 may be in the form of retaining wires 92 received in corresponding grooves formed in the exterior surface of mandrel 44 and within an interior surface of each ring 88. In one or more embodiments of the present disclosure, the retaining wires 92 may be circular, rectangular, or any other shape without departing from the scope of the present disclosure. However, other retention mechanisms 90, e.g. setscrews, threads, weldments, also may be used to secure the rings 88.

In this embodiment, the fixed angle sections 72 are formed on support rings 94 which may be mounted about mandrel 44 on axially inward sides of gripper members 70. The support rings 94 may be axially secured to mandrel 44 via ring retention mechanisms 90 in a manner similar to the securing of rings 88. For example, the ring retention mechanisms 90 may be in the form of rectangular wires, setscrews, threads, weldments, or other suitable retention mechanisms.

Use of rings 88 and support rings 94 facilitates construction of mandrel 44 with a substantially uniform thickness along its length. Additionally, the rings 88, 94 may be formed of different materials than the material used to construct mandrel 44. For example, the rings 88, 94 may be formed of other types of metal, certain elastomers, or other suitable materials for a given downhole application. It should be noted the rings 88 and support rings 94 also may be formed with axial slots 86 or other suitable features which enable controlled fracture and release of hoop stress during radial expansion of the mandrel 44.

In an operational example, the mandrel 44 is expanded radially outwards via hydraulic pressure applied along interior passage 54. By way of example, flow along interior passage 54 may be sealed off with a setting tool as described above. Hydraulic fluid may then be pumped down through the setting tool and into interior passage 54 between the packing elements of the setting tool. The pressure of the hydraulic fluid may be increased to elastically and then plastically deform the mandrel 44 in a radially outward direction.

In this example, the beam springs 56 and the gripper members 70 undergo controlled fracture during radial expansion to eliminate hoop stress via fracture along axial slots 86. The gripper members 70 and sealing element 50 are expanded along with mandrel 44 and moved into engagement with the surrounding surface 52 of outer casing/tubular 34. Once engaged with outer casing/tubular 34, the internal hydraulic pressure may be released.

During radial expansion of the beam springs 56 and gripper members 70, the beam springs 56 are able to actuate and to shift the angled section 66 of each beam spring 56 in an axial direction. Each angled section 66 squeezes against the corresponding angled surface 80 of the corresponding gripper member 70. This squeezing action via both angled sections 66 and fixed angle sections 72 tends to bias the gripper members 70 into improved engagement with the surrounding surface 52. Additionally, when the mandrel 44 is subjected to an axial load, the interaction between angled surfaces 66, 72, 80 tends to force the gripper members 70 in a radially outward direction and into firmer engagement with the surrounding surface 52. The positioning of fixed angle sections 72 and the firmer engagement of gripper members 70 with surrounding surface 52 substantially reduces the potential axial movement of the sealing element 50 relative to the surrounding surface 52.

By positioning the fixed angle sections 72 on an axially inward side of gripper members 70 while circumferential biasing members 46/beam springs 56 are positioned on an axially outward side of gripper members 70, the ability of the sealing element 50 to slide axially is resisted. When the load anchor 32 is radially expanded into engagement with surrounding surface 52, the fixed angled sections 72 block axial shifting of the sealing element 50 regardless of the direction of axial loading on mandrel 44. The resistance to or prevention of axial shifting with respect to sealing element 50 also can be accomplished by placing the circumferential biasing members 46/beam springs 56 on an axially inward side of gripper members 70 while fixed angle sections 72 are positioned on an axially outward side of gripper members 70. By reducing or eliminating the axial movement of sealing element 50 along surface 52, the life and long-term functionality of sealing element 50 may be substantially improved.

Figure 6:
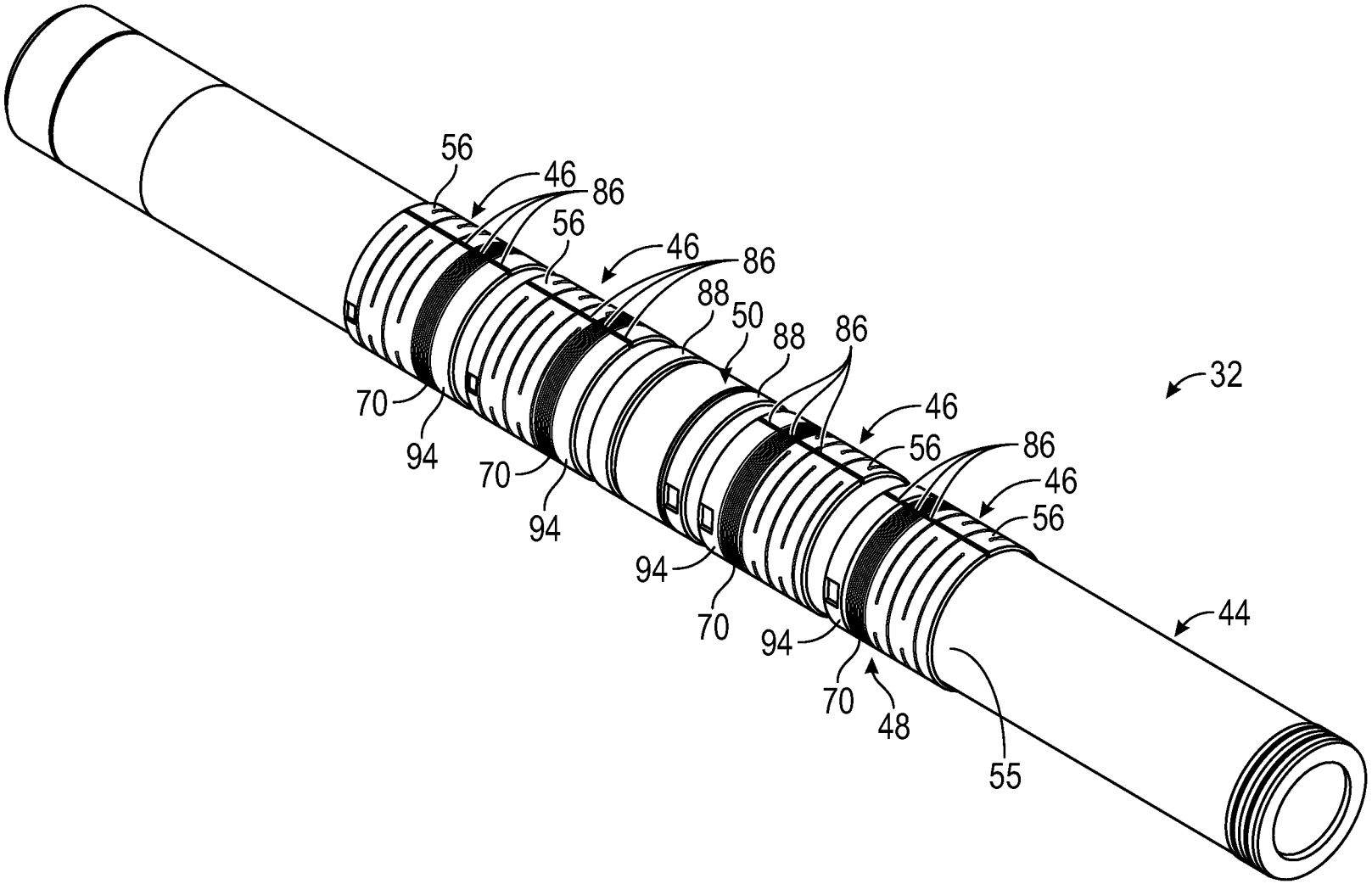
FIG. 6 is an orthogonal view of another example of the load anchor, according to one or more embodiments of the present disclosure.

It should be noted the arrangement of circumferential biasing members 46/beam springs 56; gripper members 70; rings 88, 94; sealing element 50; and/or other components of load anchor 32 may be constructed and arranged in various configurations. In the embodiment illustrated in FIG. 6, for example, a plurality of beam springs 56 and a plurality of gripper members 70 may be positioned on each axial side of the sealing element 50. By way of specific example, two beam springs 56 and two gripper members 70 are located on each axial side of sealing element 50. The sealing element 50 also may be in the form of a single sealing element or a plurality of sealing elements arranged at desired positions along the load anchor 32. In the example illustrated, circumferential biasing members 46, gripper members 70, and support rings 94 each include axial fracture slot 86. Various other numbers and arrangements of the components may be selected according to the parameters of a given application.

Basically, various arrangements of circumferential biasing members 46/beam springs 56; gripper members 70, and fixed angle sections 72 may be combined to prevent axial sliding of the sealing element 50. With one beam spring 56 and one solid piece (e.g. fixed angle section 72) per gripper member 70 arranged such that the angled sections 66 of the beam springs 56 point towards or away from each other, then loads applied to the mandrel 44 in either axial direction do not result in compression of the beam spring 56 in the direction of axial load. Compression of the subject beam spring 56 would result in sliding motion of the sealing element 50 but such compression is blocked by the corresponding solid, fixed angle section 72. Thus, various embodiments may utilize two gripper elements 70 or even numbers of gripper elements 70 greater than two. With greater numbers of gripper elements 70, half the beam springs 56 would be pointed in one axial direction and the other half would be pointed in the opposite axial direction. However, the gripper elements 70 and the beam springs 56 can be arranged in various orders and patterns with half pointing in each axial direction.

Figure 7:
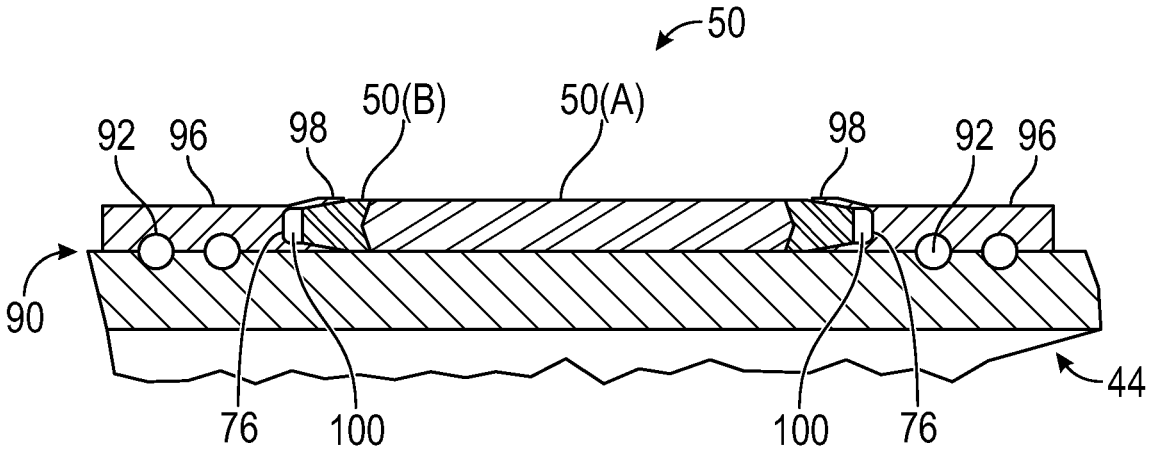
FIG. 7 is another example of a sealing element of the load anchor, according to one or more embodiments of the present disclosure.

Referring now to FIG. 7, another example of a sealing element 50 of the load anchor 32 according to one or more embodiments of the present disclosure is shown arranged on the outer surface of the mandrel 44. As shown in FIG. 7, the sealing element 50 according to one or more embodiments of the present disclosure may include a soft sealing element 50(*a*) and a hard sealing element 50(*b*) on either side of the soft sealing element, for example. According to one or more embodiments of the present disclosure, the soft sealing element 50(*a*) may include an elastomer sealing element, and the hard sealing element 50(*b*) may include a metal sealing element, for example. As previously described with respect to other embodiments of the present disclosure, hydraulic pressure may be applied to the inside of the mandrel 44, causing the mandrel 44 and the sealing element 50 to be hydraulically expanded in a radially outward direction until the mandrel 44 and at least a portion of the sealing element 50 contacts the surrounding surface 52. With sufficient expansion pressure, at least a portion of the sealing element 50 will be in permanent contact with the surrounding surface 52, and provide a barrier to fluid pressure between the mandrel 44 and the surrounding surface 52.

Still referring to FIG. 7, abutments 76 are formed on end rings 96, which may be mounted around the mandrel 44 on both sides of the sealing element 50 and axially secured to the mandrel 44 via ring retention mechanisms 90. By way of example, the ring retention mechanism 90 may be in the form of retaining wires 92 received in corresponding grooves formed in the exterior surface of the mandrel 44 and within an interior surface of each end ring 96. However, other retention mechanisms 90 e.g., setscrews, threads, weldments, also may be used to secure the end rings 96.

Still referring to FIG. 7, each end ring 96 includes a flexible lug 98 that is outwardly angled with respect to a longitudinal axis of the mandrel 44, according to one or more embodiments of the present disclosure. In one or more embodiments of the present disclosure, the lugs 98 are thin (i.e., narrow) in section relative to the bulk of the end ring 96 to facilitate flexing of the end ring 96. Moreover, the lugs 98 are angled slightly outwards and are supported by the end rings 96 and/or at least a portion of the sealing element 50 (i.e., the hard sealing element 50(B)), which counters the tendency of the lugs 98 to collapse inwardly during expansion. Instead of the hard sealing element 50(B), as shown in FIG. 7, the lugs 98 may be supported with a garter spring embedded in a soft sealing element 50(A) or other characteristically soft elastomer, a plastic component, or a metal component, without departing from the scope of the present disclosure.

As further shown in FIG. 7, there may be a gap 100 between the abutment 76 of the end ring 96 and the sealing element 50 when the load anchor 32 is in an unexpanded configuration. During hydraulic expansion of the mandrel 44 and the sealing element 50, as the sealing element 50 and the lugs 98 are squeezed against the surrounding surface 52 (e.g., the outer casing), the sealing element 50 and the lugs 98 are compressed inwardly towards the mandrel 44. Compression of the sealing element 50 in this way causes the sealing element 50 to elongate, thereby forcing the material of the sealing element 50 under the lug 98 to fill the gap 100 that was present in the unexpanded configuration. Filling the gap 100 will impart an upward force onto the lug 98, squeezing it against the surrounding surface 52. According to one or more embodiments of the present disclosure, the lug 98 has a high contact point with the surrounding surface 52, which may act as an anti-extrusion for the sealing element 50 and may also provide a metal-to-metal seal.

In another arrangement according to one or more embodiments of the present disclosure, the sealing element 50 may be reduced in size such that during hydraulic expansion of the mandrel 44 and the sealing element 50, only the lugs 98 are squeezed against the surrounding surface 52 (e.g., the outer casing). In operation, when hydraulic pressure is applied, the pressure pushes past one of the lugs 98, which has a tendency to collapse in the downward direction, as previously described. The applied pressure that pushes past the lug 98 is able to act on the underside of the other lug 98, squeezing the other lug 98 harder against the surrounding surface 52 and creating a contact force, thereby preventing pressure from escaping past the other lug 98. As the applied pressure continues, the pressure is able to eventually act on the underside of the first lug 98, squeezing the first lug harder against the surrounding surface 52 and creating another contact force. In this way, the contact forces of the lugs 98 with the surrounding surface 52 increase with applied pressure.

Figure 8:
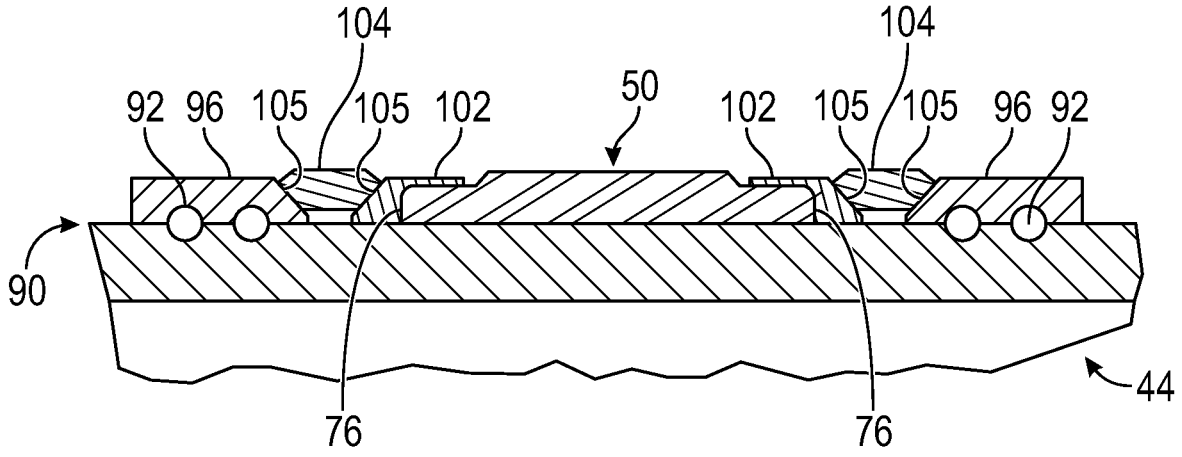
FIG. 8 is another example of a sealing element of the load anchor, according to one or more embodiments of the present disclosure.

Referring now to FIG. 8, another example of a sealing element 50 of the load anchor 32 according to one or more embodiments of the present disclosure is shown arranged on the outer surface of the mandrel 44. As shown in FIG. 8, abutments 76 are formed on compression rings 102, which may be mounted around the mandrel 44 on both sides of the sealing element 50. As further shown in FIG. 8, the load anchor 32 may also include a pair of end rings 96 mounted around the mandrel 44 and axially secured to the mandrel 44 via ring retention mechanisms 90. By way of example, the ring retention mechanism 90 may be in the form of retaining wires 92 received in corresponding grooves formed in the exterior surface of the mandrel 44 and within an interior surface of each end ring 96. However, other retention mechanisms 90 e.g., setscrews, threads, weldments, also may be used to secure the end rings 96.

Still referring to FIG. 8, the load anchor 32 further comprises two wedge rings 104 each including two angled surfaces 105, each wedge ring 104 being wedged between a given end ring 96 and a given compression ring 102 on either side of the sealing element 50 via the two angled surfaces 105 of the wedge rings 104. In this arrangement, according to one or more embodiments of the present disclosure, when the sealing element 50 comes into contact with the surrounding surface 52 (e.g., the outer casing) during hydraulic expansion, the wedge rings 104 are compressed inwards, and due to the angled surfaces 105, an axial squeezing force is applied to the sealing element 50.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a load anchor having:

a mandrel with an interior passage;

a plurality of beam springs secured along an exterior of the mandrel by retention mechanisms;

an elastomeric sealing element disposed about the mandrel and trapped between abutments in an axial position; and a plurality of gripper members disposed about the mandrel, each gripper member being axially bounded by a fixed angle section on one side and an angled section of an adjacent beam spring on the other side, each gripper member being positioned such that upon radial expansion of the mandrel the adjacent beam spring is able to transform axially and to force the gripper member in an axial direction against the fixed angle section, the fixed angle section driving the gripper member radially outward against a surrounding surface, the plurality of gripping members resisting axial shifting of the elastomeric sealing element along the surrounding surface.

2. The system as recited in claim 1, wherein the plurality of gripper members comprises a gripper member located on each axial side of the elastomeric sealing element.

3. The system as recited in claim 1, wherein the abutments are provided by rings mounted around the mandrel.

4. The system as recited in claim 3, wherein the rings mounted around the mandrel comprise end rings disposed at either side of the elastomeric sealing element, each end ring comprising a flexible lug that is outwardly angled with respect to a longitudinal axis of the mandrel.

5. The system as recited in claim 4, further comprising a gap between the abutment of the end ring and the elastomeric sealing element when the load anchor is in an unexpanded configuration.

6. The system as recited in claim 3, wherein the rings mounted around the mandrel comprise compression rings disposed at either side of the elastomeric sealing element, the load anchor further comprising:

a pair of end rings mounted around the mandrel; and two wedge rings each comprising two angled surfaces, each wedge ring being wedged between a given end ring and a given compression ring on either side of the elastomeric sealing element via the two angled surfaces.

7. The system as recited in claim 1, wherein each fixed angle section is formed as part of the mandrel.

8. The system as recited in claim 1, wherein each fixed angle section is formed on a support ring mounted about the mandrel.

9. The system as recited in claim 1, wherein the load anchor is positioned and expanded within a surrounding well casing.

10. The system as recited in claim 1, wherein the plurality of gripper members and the plurality of beam springs break, upon sufficient radial expansion, in a manner which reduces hoop stress.

11. The system as recited in claim 1, wherein the abutments are included on end rings mounted on the mandrel at either side of the elastomeric sealing element, the end rings further comprising a flexible lug that is outwardly angled from a longitudinal axis of the mandrel.

12. The system as recited in claim 1, wherein the abutments are included on compression rings mounted on the mandrel at either side of the elastomeric sealing element, the load anchor further comprising: a pair of end rings mounted on the mandrel; and an angled wedge element disposed between a given end ring and a given compression ring on either side of the elastomeric sealing element.

13. A system, comprising:

a load anchor having:

a mandrel with an interior passage, the mandrel being radially expandable when sufficient pressure is applied within the interior passage;

a pair of circumferential biasing members mounted around the mandrel, each circumferential biasing member having a biasing surface;

a gripper system positioned between the circumferential biasing members of the pair of circumferential biasing members, the gripper system being configured such that engagement with the biasing surface of either circumferential biasing member causes radially outward movement of the gripper system upon axial movement of the mandrel in either axial direction; and a sealing element disposed about the mandrel and captured axially between abutments, the sealing element being protected by the gripper system against undue axial movement along a surrounding surface once the mandrel is radially expanded to force the gripper system into engagement with the surrounding surface.

14. The system as recited in claim 13, wherein the gripper system comprises a plurality of gripper members and the sealing element is located axially between gripper members of the plurality of gripper members.

15. The system as recited in claim 13, wherein the gripper system comprises a pair of gripper members and the sealing element is located axially between the gripper members, further wherein the pair of circumferential biasing members comprises a pair of beam springs with biasing surfaces in the form of angled sections, each gripper member being positioned between one of the angled sections and a corresponding fixed angle section located along an exterior of the mandrel.

16. The system as recited in claim 13, wherein the abutments are provided by compression rings mounted around the mandrel, the compression rings being disposed at either side of the sealing element, the load anchor further comprising:

a pair of end rings mounted around the mandrel; and two wedge rings each comprising two angled surfaces, each wedge ring being wedged between a given end ring and a given compression ring on either side of the elastomeric sealing element via the two angled surfaces.

17. A method, comprising:

forming a load anchor with an expandable mandrel, a sealing element disposed around the expandable mandrel, a plurality of radially expandable gripper members, and a plurality of beam springs positioned to act against the gripper members;

deploying the load anchor into a well tubing;

increasing pressure within the expandable mandrel to radially expand the expandable mandrel, thus radially expanding the radially expandable gripper members into engagement with the well tubing; and protecting the sealing element against detrimental sliding motion with respect to the well tubing by providing the beam springs with engagement surfaces oriented to bias the radially expandable gripper members into more secure engagement with the well tubing upon axial loading of the expandable mandrel.

18. The method as recited in claim 17, further comprising locating the sealing element axially between abutments provided by end rings mounted around the mandrel, the end rings being disposed at either side of the sealing element, each end ring comprising a flexible lug that is outwardly angled with respect to a longitudinal axis of the mandrel.

19. The method as recited in claim 18, wherein, before the increasing pressure step, the load anchor comprises a gap between the abutment of the end ring and the sealing element.

20. The method as recited in claim 17, further comprising:

locating the sealing element axially between abutments provided by compression rings mounted around the mandrel, the compression rings being disposed at either side of the sealing element, mounting a pair of end rings around the mandrel; and wedging a wedge ring comprising two angled surfaces, between a given end ring and a given compression ring on both sides of the sealing element via the two angled surfaces.

* * * * *